US007019603B2

(12) United States Patent
Yoneda et al.

(10) Patent No.: US 7,019,603 B2
(45) Date of Patent: Mar. 28, 2006

(54) WAVEGUIDE TYPE ORTHO MODE TRANSDUCER

(75) Inventors: Naofumi Yoneda, Tokyo (JP); Moriyasu Miyazaki, Tokyo (JP); Yoji Aramaki, Tokyo (JP); Akira Tumura, Tokyo (JP); Toshiyuki Horie, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/475,335

(22) PCT Filed: Mar. 14, 2003

(86) PCT No.: PCT/JP03/03099

§ 371 (c)(1),
(2), (4) Date: Oct. 21, 2003

(87) PCT Pub. No.: WO03/079483

PCT Pub. Date: Sep. 25, 2003

(65) Prior Publication Data

US 2004/0246069 A1 Dec. 9, 2004

(30) Foreign Application Priority Data

Mar. 20, 2002 (JP) ..... 2002-078178

(51) Int. Cl.
*H01P 5/12* (2006.01)

(52) U.S. Cl. ..... 333/125; 333/126; 333/122; 333/137; 333/21 A; 333/21 R

(58) Field of Classification Search ..... 333/125, 333/137, 114, 122, 126, 21 A, 21 R
See application file for complete search history.

(56) References Cited

U.S. PATENT DOCUMENTS 2,686,901 A * 8/1954 Dicke ..... 333/21 R
2,965,898 A * 12/1960 Lewis ..... 342/365
3,058,072 A * 10/1962 Rizzi ..... 333/210

(Continued)

FOREIGN PATENT DOCUMENTS

EP 1 109 245 A2 6/2001

(Continued)

OTHER PUBLICATIONS

Boifot, Anton M.; "Classification of Ortho-Mode Transducer;" European Transactions on Telecommunications and Related Technologies vol. 2, No. 5; Sep. 1991; pp. 35-42.

(Continued)

*Primary Examiner*—Robert Pascal
*Assistant Examiner*—Kimberly Glenn
(74) *Attorney, Agent, or Firm*—Birch, Stewart, Kolasch & Birch, LLP

(57) ABSTRACT

An object of the present invention is to obtain a waveguide type polarizer, which enables miniaturization thereof, shortening of an axis, and broad band promotion, and which has high performance. In order to attain the object, the waveguide type polarizer includes: a first rectangular main waveguide 1; first to fourth rectangular branching waveguides 2*a* to 2*d* branching perpendicularly to the first rectangular main waveguide 1; a short-circuit plate 3 connected to one terminal of the first rectangular main waveguide 1; a metallic block 4 provided on the short-circuit plate 3; a rectangular waveguide step 5 connected to the other terminal of the first rectangular main waveguide 1; and a second rectangular main waveguide 6 connected to the rectangular waveguide step 5.

20 Claims, 15 Drawing Sheets

U.S. PATENT DOCUMENTS

| | | | | | |
|---|---|---|---|---|---|
| 3,680,145 | A | * | 7/1972 | Beguin | 343/786 |
| 4,041,420 | A | * | 8/1977 | Riblet | 333/35 |
| 4,047,128 | A | * | 9/1977 | Morz | 333/122 |
| 4,074,265 | A | * | 2/1978 | True | 342/15 |
| 4,141,013 | A | * | 2/1979 | Crail et al. | 343/756 |
| 4,167,715 | A | * | 9/1979 | Ohm | 333/125 |
| 4,200,847 | A | * | 4/1980 | Nishikawa et al. | 333/125 |
| 5,305,001 | A | * | 4/1994 | Wong et al. | 343/786 |
| 6,225,875 | B1 | * | 5/2001 | Kich | 333/125 |
| 6,313,714 | B1 | * | 11/2001 | Junker et al. | 333/125 |
| 6,642,901 | B1 | * | 11/2003 | Matsumoto et al. | 343/786 |

FOREIGN PATENT DOCUMENTS

| | | | | |
|---|---|---|---|---|
| GB | 870 873 | | | 6/1961 |
| JP | 115842/1979 | | | 8/1979 |
| JP | 59-44801 | B2 | | 11/1984 |
| JP | 61-52002 | A | | 3/1986 |
| JP | 62-51801 | A | | 3/1987 |
| JP | 181003/1987 | | | 11/1987 |
| JP | 85901/1988 | | | 6/1988 |
| JP | 03253101 | A | * | 11/1991 |
| JP | 50802/1993 | | | 7/1993 |
| JP | 6-85502 | A | | 3/1994 |
| JP | 7-321504 | A | | 12/1995 |
| JP | 9-307305 | A | | 11/1997 |
| JP | 10-32406 | A | | 2/1998 |
| JP | 11-330801 | A | | 11/1999 |

OTHER PUBLICATIONS

Bertin G. et al.; "Advanced Computer Design for a High Performace Compact Ortho-Mode Transducer;" IEEE Antennas and Propagation Society, International Symposium 1998 Digest; Jun. 1998; pp. 2254-2257.

* cited by examiner

ELECTRIC FIELD

WAVEGUIDE TYPE ORTHO MODE TRANSDUCER

This application is the national phase under 35 U.S.C. § 371 of PCT International Application No. PCT/JP03/03099 which has an International filing date of Mar. 14, 2003, which designated the United States of America.

TECHNICAL FIELD

The present invention relates to a waveguide type polarizer mainly used in a VHF band, a UHF band, a microwave band and a millimeter wave band.

BACKGROUND ART

FIG. 13 is a perspective view showing a construction of a conventional waveguide type polarizer shown in JP 11-330801 A, for example. In addition, FIG. 14 is a side view of a branch portion useful in explaining a distribution of an electric field of a basic mode when inputting a horizontally polarized wave in the waveguide type polarizer shown in FIG. 13. Moreover, FIG. 15 is a cross sectional view of a main waveguide useful in explaining a distribution of an electric field of an unnecessary higher mode generated when inputting a horizontally polarized wave in the waveguide polarizer shown in FIG. 13.

In FIGS. 13 to 15, reference numeral 31 designates a rectangular main waveguide through which a vertically polarized electric wave and a horizontally polarized electric wave are transmitted; reference symbols 32*a* and 32*b* respectively designate two rectangular branching waveguides branching perpendicularly and symmetrically with respect to a tube axis of the main waveguide 31; reference symbols 33*a* and 33*b* respectively designate metallic thin plates which are inserted into the main waveguide 61 and which each have arcuate cutouts symmetrically formed; reference symbol P1 designates an input terminal of the main waveguide 31; reference symbol P2 designates an output terminal of the main waveguide 31; reference symbols P3 and P4 respectively designate output terminals of the branching waveguides 32*a* and 32*b*; reference symbol H designates a horizontally polarized electric wave; and reference symbol V designates a vertically polarized electric wave.

Next, an operation will hereinbelow be described. For a basic mode (TE01-mode) of the horizontally polarized electric wave H inputted through the terminal P1 of the main waveguide 31, each of a space defined between an upper sidewall of the main waveguide 31 and the metallic thin plate 33*a*, a space defined between the metallic thin plates 33*a* and 33*b*, and a space defined between the metallic thin plate 33*b* and a lower sidewall of the main waveguide 31 is designed so as to be equal to or smaller than a half of a free-space wavelength of a frequency band in use. Thus, the horizontally polarized electric wave H hardly leaks to the terminal P2 side of the main waveguide 31 due to those cut-off effects.

In addition, since as shown in FIG. 14, arcuate cutouts are symmetrically formed in each of the metallic thin plates 33*a* and 33*b*, when inputting the horizontally polarized wave, an electric field is distributed in a state in which two rectangular waveguide E-plane arcuate bends excellent in reflection characteristics are equivalently placed in a branch portion into a symmetrical form. Thus, the horizontally polarized electric wave H of a basic mode inputted through the terminal P1 is efficiently outputted to the terminals P3 and P4 while suppressing a reflection to the terminal P1 and a leakage to the terminal P2.

Moreover, the two metallic thin plates 33*a* and 33*b* have the same shape, take a vertically symmetrical shape within the main waveguide 31 and are mounted in positions away from the vicinity of a center. Thus, as shown in FIG. 15, when inputting the horizontally polarized wave, the vertically symmetrical planes become magnetic walls in a region defined between the metallic thin plates 33*a* and 33*b* and hence, in principal, a TE20-mode as a higher mode causing a degradation of the reflection characteristics is not generated. As a result, an effect is obtained in that the degradation of the reflection characteristics when inputting the horizontally polarized wave can be suppressed to a frequency band with a frequency about twice as high as a cut-off frequency of a basic mode (TE01-mode) of the horizontally polarized wave H.

On the other hand, for a vertically polarized electric wave V of a basic mode (TE10-mode) inputted through the terminal P1 of the main waveguide 31, each of a sidewall space defined between surfaces each having a large width of the branching waveguide 32*a* and a sidewall space defined between surfaces each having a large width of the branching waveguide 32*b* is designed so as to be equal to or smaller than a half of the free-space wavelength of the frequency band in use. Thus, the vertically polarized electric wave hardly leaks to the sides of the terminal P3 and the terminal P4 of the branching waveguides 32*a* and 32*b* due to those cut-off effects.

In addition, the metallic thin plates 33*a* and 33*b* are mounted so that the plate surfaces thereof perpendicularly intersect a direction of an electric field of the vertically polarized wave V in the main waveguide 31, and also a thickness of each of the metallic thin plates 33*a* and 33*b* is designed so as to be much smaller than the free-space wavelength of the frequency band in use. For this reason, the electric wave V of the basic mode is hardly reflected by the metallic thin plates 33*a* and 33*b*. Therefore, the vertically polarized electric wave V of the basic mode inputted through the terminal P1 is efficiently outputted to the terminal P2 while suppressing the reflection to the terminal P1 and the leakage to the terminals P3 and P4.

The conventional waveguide type polarizer is constituted by: the rectangular main waveguide 31; the two rectangular branching waveguides 32*a* and 32*b* branching perpendicularly and symmetrically with respect to the tube axis of the main waveguide 31; and the metallic thin plates 32*a* and 32*b* inserted into the main waveguide 31. Then, the vertically polarized wave and the horizontally polarized wave which have entered through the input terminal P1 of the main waveguide 31 are outputted through the output terminal P2 of the main waveguide 31 and the output terminals P3 and P4 of the branching waveguides 32*a* and 32*b*, respectively. Thus, there arises a problem in that a miniaturization, and shortening of the axis are difficult to be made with respect to a direction of the tube axis of the main waveguide 31.

In addition, in general, in a frequency band in the vicinity of the cut-off frequencies of the basic modes (the TE10-mode and the TE01-mode) of the vertically polarized wave and the horizontally polarized wave, an abrupt change in frequency of a guide wavelength is observed, and along therewith, an abrupt change in frequency of discontinuity of an impedance in the branch portion of the rectangular waveguide 31 is also involved. Thus, in the conventional waveguide type polarizer, it is difficult to suppress the degradation of the reflection characteristics of both the polarized waves in a frequency band in the vicinity of the cut-off frequencies.

The present invention has been made in order to solve the problems as described above, and it is therefore an object of the present invention to obtain a waveguide type polarizer, which enables a miniaturization thereof, shortening of an axis, and broad band promotion, and which has high performance.

DISCLOSURE OF THE INVENTION

A waveguide type polarizer according to an aspect of the present invention includes: a first rectangular main waveguide; first to fourth rectangular branching waveguides branching perpendicularly to the first rectangular main waveguide; a short-circuit plate connected to one terminal of the first rectangular main waveguide; a metallic projection provided on the short-circuit plate; a rectangular waveguide step connected to the other terminal of the first rectangular main waveguide; and a second rectangular main waveguide connected to the rectangular waveguide step.

Also, a waveguide type polarizer according to another aspect of the present invention includes: a first rectangular main waveguide; first to fourth rectangular branching waveguides branching perpendicularly to the first rectangular main waveguide; a short-circuit plate connected to one terminal of the first rectangular main waveguide; a metallic projection provided on the short-circuit plate; a circular-rectangular waveguide step connected to the other terminal of the first rectangular main waveguide; and a circular main waveguide connected to the circular-rectangular waveguide step.

Further, a waveguide type polarizer according to another aspect of the present invention includes: a first rectangular main waveguide; first and second rectangular branching waveguides branching perpendicularly to the first rectangular main waveguide; first and second conductor thin plates which are mounted in a pair in symmetrical positions within the first rectangular main waveguide; a rectangular waveguide step which is connected to the other terminal of the first rectangular main waveguide, and has an opening diameter that is decreased toward a branch portion of the first rectangular main waveguide for the first and second rectangular branching waveguides; and a second rectangular main waveguide connected to the rectangular waveguide step.

BEST MODE FOR CARRYING OUT THE INVENTION

Hereinafter, an embodiment mode of the present invention will be described.

Embodiment Mode 1

Figure 1:
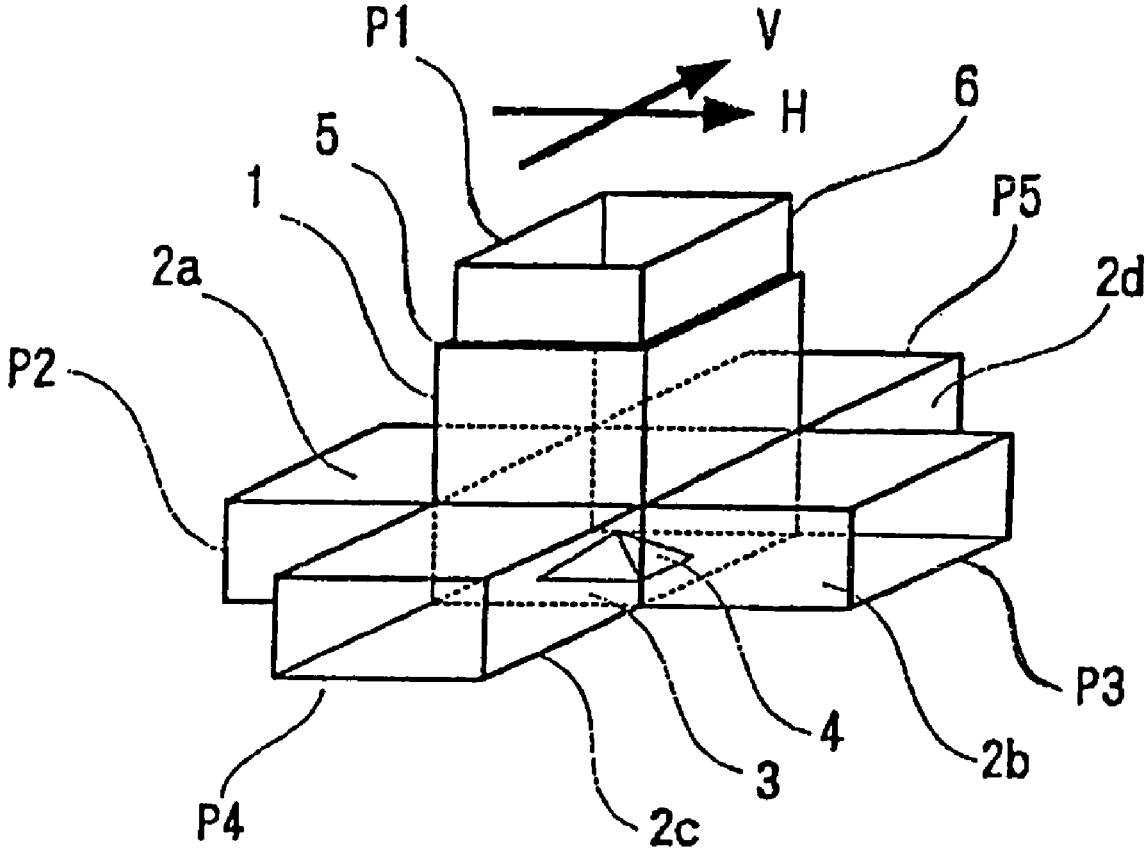
FIG. 1 is a perspective view of a waveguide type polarizer according to Embodiment Mode 1 of the present invention.

FIG. 1 is a perspective view showing a construction of a waveguide type polarizer according to Embodiment Mode 1 of the present invention. In addition, FIG. 2 is a side view of a branch portion useful in explaining a distribution of an electric wave of a basic mode when inputting a horizontally polarized wave in the waveguide type polarizer shown in FIG. 1.

Figure 2:
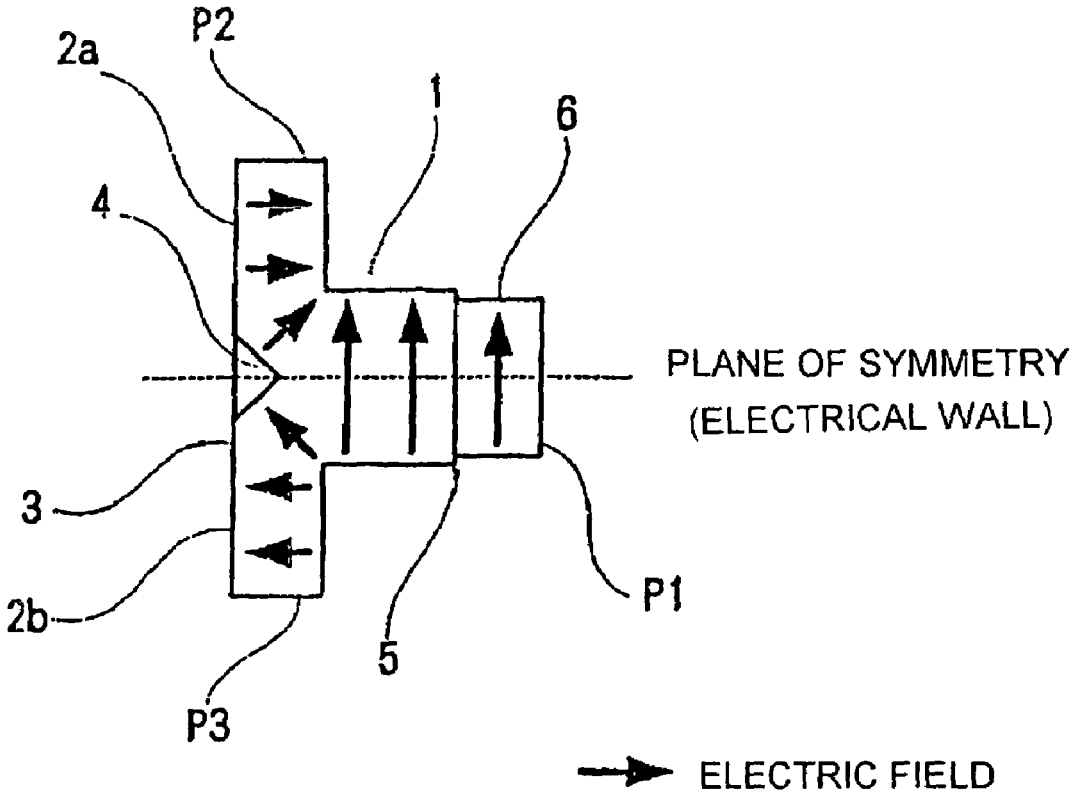
FIG. 2 is an explanatory view showing an operation of wave branching of an electric wave.

In FIG. 1 and FIG. 2, reference numeral 1 designates a first square main waveguide through which a vertically polarized electric wave and a horizontally polarized electric wave are transmitted; reference symbols 2*a* to 2*d* respectively designate first to fourth rectangular branching waveguides branching perpendicularly and symmetrically with respect to a tube axis of the square main waveguide 1; reference numeral 3 designates a short-circuit plate for shutting one terminal of the square main waveguide 1; reference numeral 4 designates a square pyramid-like metallic block which is provided within the square main waveguide 1 and on the short-circuit plate 3; reference numeral 5 designates a square waveguide step which is connected to one terminal of the square main waveguide 1, an opening diameter of which is increased toward branch portions of the square main waveguide 1 for the first to fourth rectangular branching waveguides 2*a* to 2*d*, and a stepped portion of which is much smaller than a free-space wavelength of a frequency band in use; reference numeral 6 designates a second square main waveguide which is connected to the square waveguide step 5 and through which a vertically polarized electric wave and a horizontally polarized electric wave are transmitted; reference symbol P1 designates an input terminal of the square main waveguide 6; reference symbols P2 to P5 respectively designate output terminals of the rectangular branching waveguides 2*a* to 2*d*; reference symbol H designates a horizontally polarized electric wave; and reference symbol V designates a vertically polarized electric wave.

Next, an operation will hereinbelow be described. Now, assuming that the horizontally polarized electric wave H of a basic mode (TE01-mode) is inputted through the terminal P1, this electric wave is propagated through the square waveguide step 5, the square main waveguide 1, and the rectangular branching waveguides 2*a* and 2*b* to be outputted in the form of electric waves of a basic mode (TE10-mode) in each branching waveguide through the terminals P2 and P3, respectively.

Here, for the electric wave H, each of spaces defined between upper and lower sidewalls of the rectangular branching waveguides 2*c* and 2*d* is designed so as to be equal to or smaller than a half of the free-space wavelength of the frequency band in use. Thus, the electric wave H hardly leaks to the sides of the terminals P4 and P5 due to the cut-off effect of those spaces. In addition, since a direction of the electric field can be changed along the metallic block 4 and the short-circuit plate 3 as shown in FIG. 2, an electric field is distributed in a state in which two rectangular waveguide E-planes miter-like bends excellent in reflection characteristics are equivalently and symmetrically placed. Thus, the electric wave H inputted through the terminal P1 is efficiently outputted to the terminals P2 and P3 while suppressing the reflection to the terminal P1 and the leakage to the terminals P4 and P5.

Moreover, the square waveguide step 5 is designed such that a stepped portion thereof is much smaller than the free-space wavelength of the frequency band in use. For this reason, with respect to the reflection characteristics thereof, a reflection loss is large in a frequency band in the vicinity of the cut-off frequency of the basic mode of the electric wave H, while it is very small in a frequency band any frequency of which is higher than the cut-off frequency to some extent. This is similar to reflection characteristics of the above-mentioned branch portion. Therefore, the square waveguide step 5 is installed in a position where a reflected wave from the branch portion and a reflected wave due to the square waveguide step 5 cancel each other in the vicinity of the cut-off frequency, so that it becomes possible to suppress a degradation of the reflection characteristics in the frequency band in the vicinity of the cut-off frequency without impairing a satisfactory reflection characteristics in the frequency band any frequency of which is higher than the cut-off frequency of the basic mode of the electric wave H to some extent.

On the other hand, assuming that the vertically polarized wave V of the basic mode (TE10-mode) is inputted through the terminal P1, this electric wave is propagated through the square waveguide step 5, the square main waveguide 1 and the rectangular branching waveguides 2*c* and 2*d* to be outputted in the form of electric waves of the basic mode (TE10-mode) in each branching waveguide through the terminals P4 and P5, respectively.

Here, for the electric wave V, each of spaces defined between upper and lower sidewalls of the rectangular branching waveguides 2*a* and 2*b* is designed so as to be equal to or smaller than a half of the free-space wavelength of the frequency band in use. Thus, the electric wave V hardly leaks to the sides of the terminals P2 and P3 due to the cut-off effect of those spaces. In addition, since a direction of the electric field is changed along the metallic block 4 and the short-circuit plate 3 as shown in FIG. 2, the electric field is distributed in a state in which two rectangular waveguide E-plane miter-like bends excellent in reflection characteristics are equivalently and symmetrically placed. Thus, the electric wave V inputted through the terminal P1 is efficiently outputted to the terminals P4 and P5 while suppressing the reflection to the terminal P1 and the leakage to the terminals P2 and P3.

Moreover, the square waveguide step 5 is designed such that a stepped portion thereof is much smaller than the free-space wavelength of the frequency band in use. Thus, with respect to the reflection characteristics thereof, a reflection loss is large in a frequency band in the vicinity of the cut-off frequency of the basic mode of the electric wave V, while it is very small in a frequency band any frequency of which is higher than the cut-off frequency to some extent. This is similar to the reflection characteristics of the above-mentioned branch portion. Therefore, the square waveguide step 5 is installed in a position where a reflected wave from the branch portion and a reflected wave due to the square waveguide step 5 cancel each other in the vicinity of the cut-off frequency, so that it becomes possible to suppress the degradation of the reflection characteristics in the frequency band in the vicinity of the cut-off frequency without impairing the satisfactory reflection characteristics in the frequency band any frequency of which is higher than the cut-off frequency of the basic mode of the electric wave H to some extent.

The above-mentioned operation principles have been described with respect to the case where the terminal P1 is determined as an input terminal, and the terminals P2 to P5 are set as output terminals. However, the above-mentioned operation principles are applied to a case as well where the terminals P2 to P5 are determined as input terminals, the terminal P1 is determined as an output terminal, input waves inputted through the terminals P2 and P3 are made 180 degrees out of phase with each other and are made equal in amplitude to each other, and input waves inputted through the terminals P4 and P5 are made 180 degrees out of phase with each other and are made equal in amplitude to each other.

As described above, according to Embodiment Mode 1, the polarizer is constituted by: the first and second square main waveguides; the first to fourth rectangular branching waveguides; the short-circuit plate for shutting one terminal of the square main waveguide; the square pyramid-like metallic block provided on the short-circuit plate; and the square waveguide step which is sandwiched between the first square main waveguide and the second square main waveguide, and has an opening diameter that is increased toward the branch portion. Thus, an effect is obtained in that it is possible to realize satisfactory reflection characteristics and isolation characteristics in a broad frequency band including the vicinity of the cut-off frequency of the basic mode of the square main waveguide.

In addition, since the four rectangular branching waveguides branches perpendicularly and symmetrically with respect to the tube axis of the square main waveguide, an effect is obtained in that miniaturization can be promoted for a direction of the tube axis of the square main waveguide.

Moreover, since a construction is adopted in which a metallic thin plate and a metallic post are not used, an effect is obtained in that a level of difficulty for processing can be lowered, with the result that the cost reduction promotion can be realized.

Note that, while in Embodiment Mode 1, the description has been given of the case where the square pyramid-like metallic block 4 is provided as a metallic projection for changing a direction of an electric field as shown in FIG. 2, the present invention is not intended to be limited thereto. Thus, even if a metallic block having a step-like or arcuate cutout is provided, the same effects can be obtained.

Embodiment Mode 2

Figure 3:
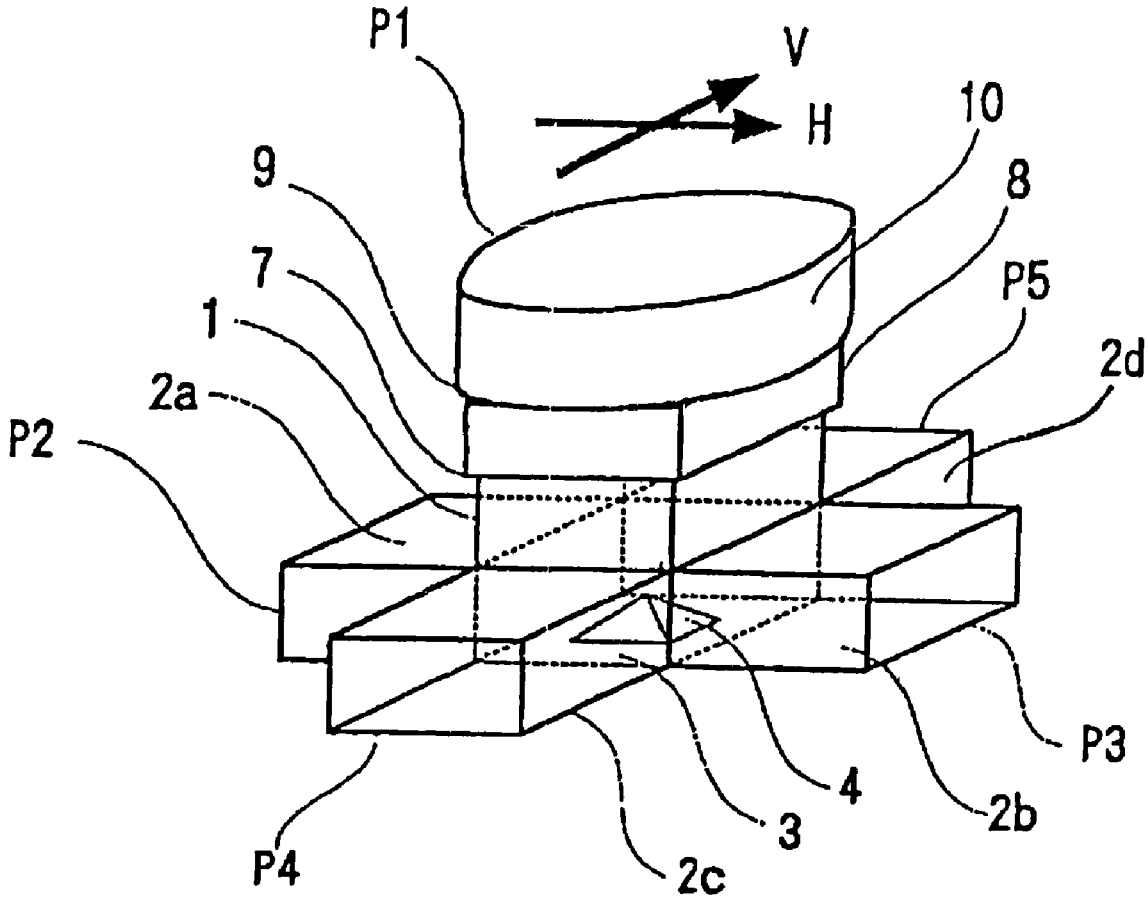
FIG. 3 is a perspective view of a waveguide type polarizer according to Embodiment Mode 2 of the present invention.

FIG. 3 is a perspective view showing a construction of a waveguide type polarizer according to Embodiment Mode 2 of the present invention. In FIG. 3, reference numeral 7 designates a square waveguide step which is connected to one terminal of a first square waveguide 1, and has an opening diameter that is decreased toward the branch portion; reference numeral 8 designates a second square main waveguide which is connected to the square waveguide step 7 and through which a vertically polarized electric wave and a horizontally polarized electric wave are transmitted; reference numeral 9 designates a circular-square waveguide step connected to the second square main waveguide 8; reference numeral 10 designates a circular main waveguide which is connected to the circular-square waveguide step 9 and through which a vertically polarized electric wave and a horizontally polarized electric wave are transmitted; reference symbol P1 designates an input terminal of the circular main waveguide 10; reference symbols P2 to P5 respectively designate output terminals of the rectangular branching waveguides 2*a* to 2*d*; reference symbol H designates a horizontally polarized electric wave; and reference symbol V designates a vertically polarized electric wave.

Next, an operation will hereinbelow be described. Now, assuming that the horizontally polarized electric wave H of a basic mode (TE01-mode) is inputted through the terminal P1, this electric wave is propagated through the circular-square waveguide step 9, the square main waveguide 8, the square waveguide step 7, the square main waveguide 1, and the rectangular branching waveguides 2*a* and 2*b* to be outputted in the form of electric waves of a basic mode (TE10-mode) in each branching waveguide through the terminals P2 and P3, respectively.

Here, for the electric wave H, each of spaces defined between upper and lower sidewalls of the rectangular branching waveguides 2*c* and 2*d* is designed so as to be equal to or smaller than a half of the free-space wavelength of the frequency band in use. Thus, the electric wave H hardly leaks to the sides of the terminals P4 and P5 due to the cut-off effect of those spaces. In addition, since a direction of the electric field is changed along the metallic block 4 and the short-circuit plate 3 as shown in FIG. 2, the electric field is distributed in a state in which two rectangular waveguide E-plane miter-like bends excellent in reflection characteristics are equivalently and symmetrically placed. For this reason, the electric wave H inputted through the terminal P1 is efficiently outputted to the terminals P2 and P3 while suppressing the reflection to the terminal P1 and the leakage to the terminals P4 and P5.

Furthermore, the circular-square waveguide step 9, the square main waveguide 8, and the square waveguide step 7 are operated in the form of a circular-rectangular waveguide multistage transformer. For this reason, a diameter of the circular main waveguide 10, a diameter of the square main waveguide 8, and a length of the tube axis of the square main waveguide 8 are suitably designed, so that as the reflection characteristics of the multistage transformer, a reflection loss can be made large in a frequency band in the vicinity of the cut-off frequency of the basic mode of the electric wave H, while it is can be made very small in a frequency band any frequency of which is higher than the cut-off frequency to some extent. This is similar to the reflection characteristics of the above-mentioned branch portion. Therefore, the square waveguide step 7 and the circular-square waveguide step 9 are installed in positions where a reflected wave from the branch portion, and reflected waves due to the square waveguide step 7 and the circular-square waveguide step 9 cancel each other in the vicinity of the cut-off frequency, so that it becomes possible to suppress the degradation of the reflection characteristics in a frequency band in the vicinity of the cut-off frequency without impairing the excellent reflection characteristics in a frequency band any frequency of which is higher than the cut-off frequency of the basic mode of the electric wave H to some extent.

On the other hand, assuming that the vertically polarized electric wave V of a basic mode (TE10-mode) is inputted through the terminal P1, this electric wave is propagated through the circular-square waveguide step 9, the square main waveguide 8, the square waveguide step 7, the square main waveguide 1, and the rectangular branching waveguides 2*c* and 2*d* to be outputted in the form of electric waves of a basic mode (TE10-mode) in each branching waveguide through the terminals P4 and P5, respectively.

Here, for the electric wave V, each of spaces defined between upper and lower sidewalls of the rectangular branching waveguides 2*a* and 2*b* is designed so as to be equal to or smaller than a half of the free-space wavelength of the frequency band in use. Thus, the electric wave V hardly leaks to the sides of the terminals P2 and P3 due to the cut-off effect of those spaces. In addition, since a direction of the electric field is changed along the metallic block 4 and the short-circuit plate 3 as shown in FIG. 2, the electric field is distributed in a state in which two rectangular waveguide E-plane miter-like bends excellent in reflection characteristics are equivalently and symmetrically placed. For this reason, the electric wave V inputted through the terminal P1 is efficiently outputted to the terminals P4 and P5 while suppressing the reflection to the terminal P1 and the leakage to the terminals P2 and P3.

Furthermore, the circular-square waveguide step 9, the square main waveguide 8, and the square waveguide step 7 are operated in the form of a circular-rectangular waveguide multistage transformer. For this reason, a diameter of the circular main waveguide 10, a diameter of the square main waveguide 8, and a length of the tube axis of the square main waveguide 8 are suitably designed, whereby as the reflection characteristics of the multistage transformer, a reflection loss can be made large in a frequency band in the vicinity of the cut-off frequency of the basic mode of the electric wave V, while it is can be made very small in a frequency band any frequency of which is higher than the cut-off frequency to some extent. This is similar to the reflection characteristics of the above-mentioned branch portion. Therefore, the square waveguide step 7 and the circular-square waveguide step 9 are installed in positions where a reflected wave from the branch portion, and reflected waves due to the square waveguide step 7 and the circular-square waveguide step 9 cancel each other in the vicinity of the cut-off frequency, so that it becomes possible to suppress the degradation of the reflection characteristics in a frequency band in the vicinity of the cut-off frequency without impairing the excellent reflection characteristics in a frequency band any frequency of which is higher than the cut-off frequency of the basic mode of the electric wave V to some extent.

The above-mentioned operation principles have been described with respect to the case where the terminal P1 is determined as an input terminal, and the terminals P2 to P5 are determined as output terminals. However, the above-mentioned operation principles are applied to a case where the terminals P2 to P5 are determined as input terminals, the terminal P1 is determined as an output terminal, input waves inputted through the terminals P2 and P3 are made 180 degrees out of phase with each other and are made equal in amplitude to each other, and input waves inputted through the terminals P4 and P5 are made 180 degrees out of phase with each other and are made equal in amplitude to each other.

As described above, according to Embodiment Mode 2, the polarizer is constituted by: the first and second square main waveguides; the one circular main waveguide; the first to fourth rectangular branching waveguides; the short-circuit plate for shutting one terminal of the first square main waveguide; the square pyramid-like metallic block provided on the short-circuit plate; the square waveguide step which is sandwiched between the first square main waveguide and the second square main waveguide and has an opening diameter that is decreased toward the branch portion; and the circular-square waveguide step sandwiched between the second square main waveguide and the circular main waveguide. Thus, an effect is obtained in that the excellent reflection characteristics and isolation characteristics can be realized in a broad frequency band including the vicinity of the cut-off frequency of the basic mode in the square main waveguide.

In addition, since the four rectangular branching waveguides branch perpendicularly and symmetrically with respect to the tube axis of the square main waveguide, an effect is obtained in that miniaturization can be performed for a direction of the tube axis of the square main waveguide.

In addition, since the opening shape of the waveguide for the input terminal is circular, when this polarizer and a circular horn antenna primary radiator are combined with each other for use, excellent impedance matching is obtained between those components. Therefore, an effect is obtained in that the reduction of an impedance transformer which is normally provided between a polarizer and an antenna primary radiator can be performed to thereby realize further miniaturization.

Moreover, since a construction is adopted in which a metallic thin plate and a metallic post are not used, an effect is obtained in that the level of difficulty for processing can be lowered, with the result that the cost reduction promotion can be realized.

Embodiment Mode 3

Figure 4:
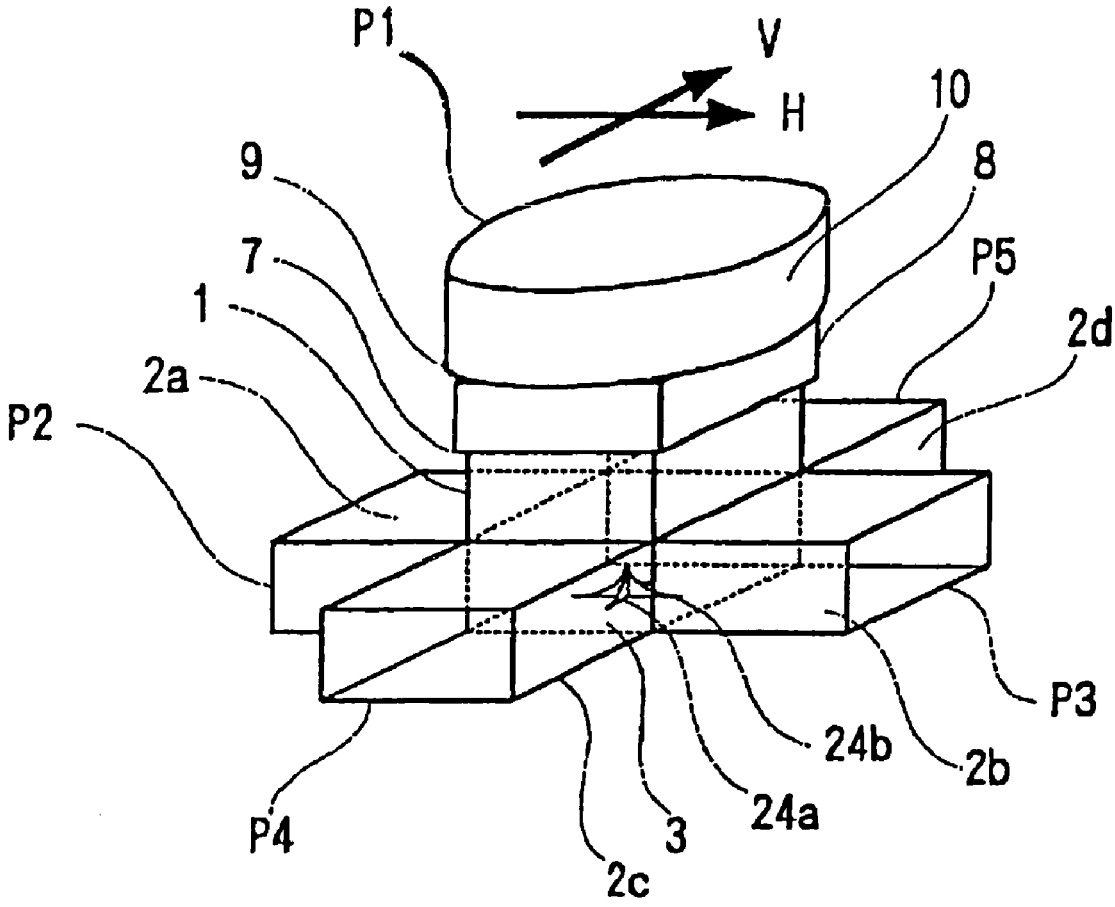
FIG. 4 is a perspective view of a waveguide type polarizer according to Embodiment Mode 3 of the present invention.

In Embodiment Mode 2 above, the description has been given of the waveguide type polarizer in which the square pyramid-like metallic block 4 is provided as the metallic projection on the short-circuit plate 3. However, if as shown in FIG. 4, the metallic thin plates 24*a* and 24*b* each having arcuate cutouts are provided so as to perpendicularly intersect each other on the short-circuit plate 3 instead of the metallic block 4, then an effect is obtained in that a reduction in weight of the polarizer can be further promoted without impairing the effect of the broad band promotion and the miniaturization. In addition, metallic thin plates each having a linear or step-like cutout may also be provided as the metallic projection so as to perpendicularly intersect each other instead of the metallic thin plates each having arcuate cutouts.

Embodiment Mode 4

Figure 5:
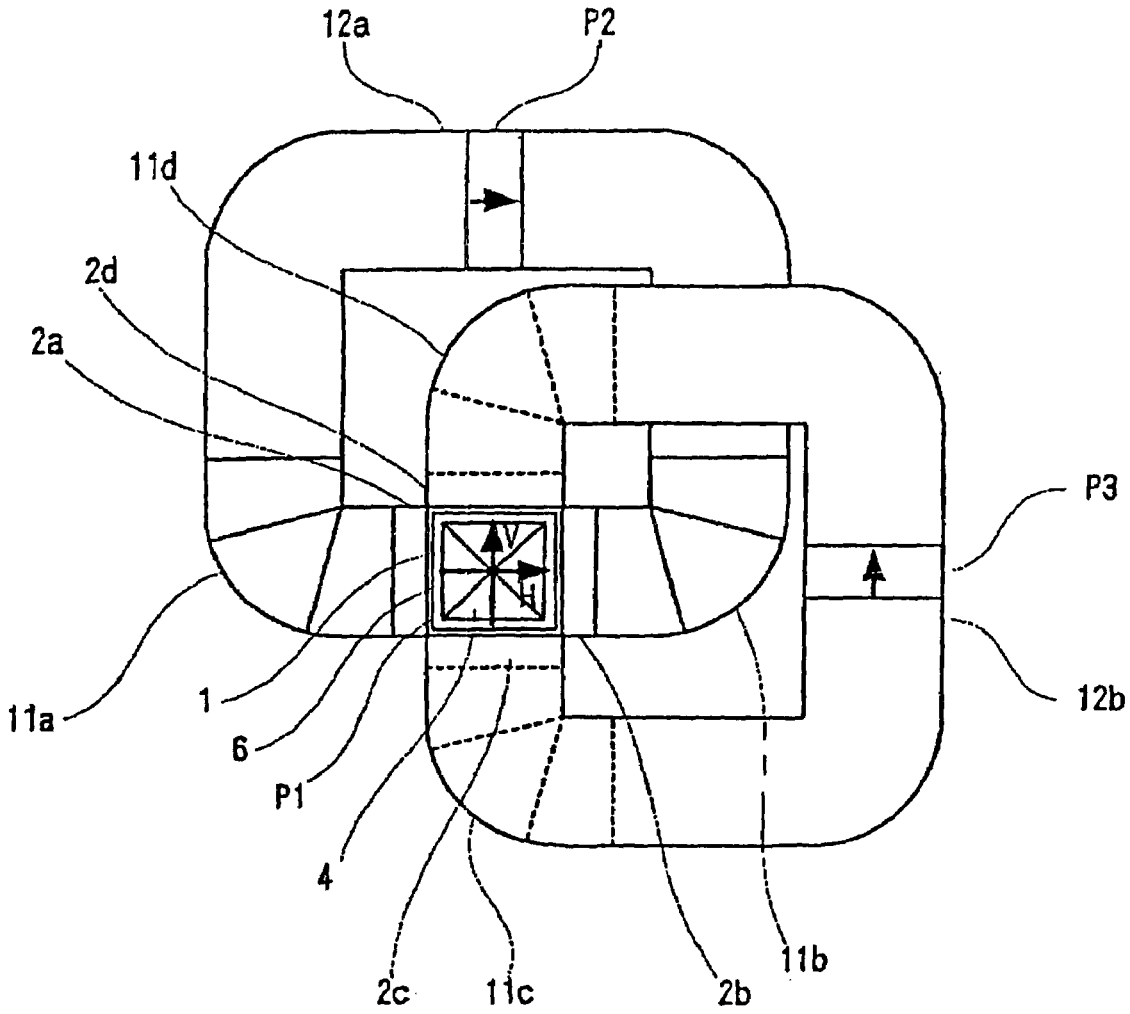
FIG. 5 is a plan view of a waveguide type polarizer according to Embodiment Mode 4 of the present invention.
Figure 6:
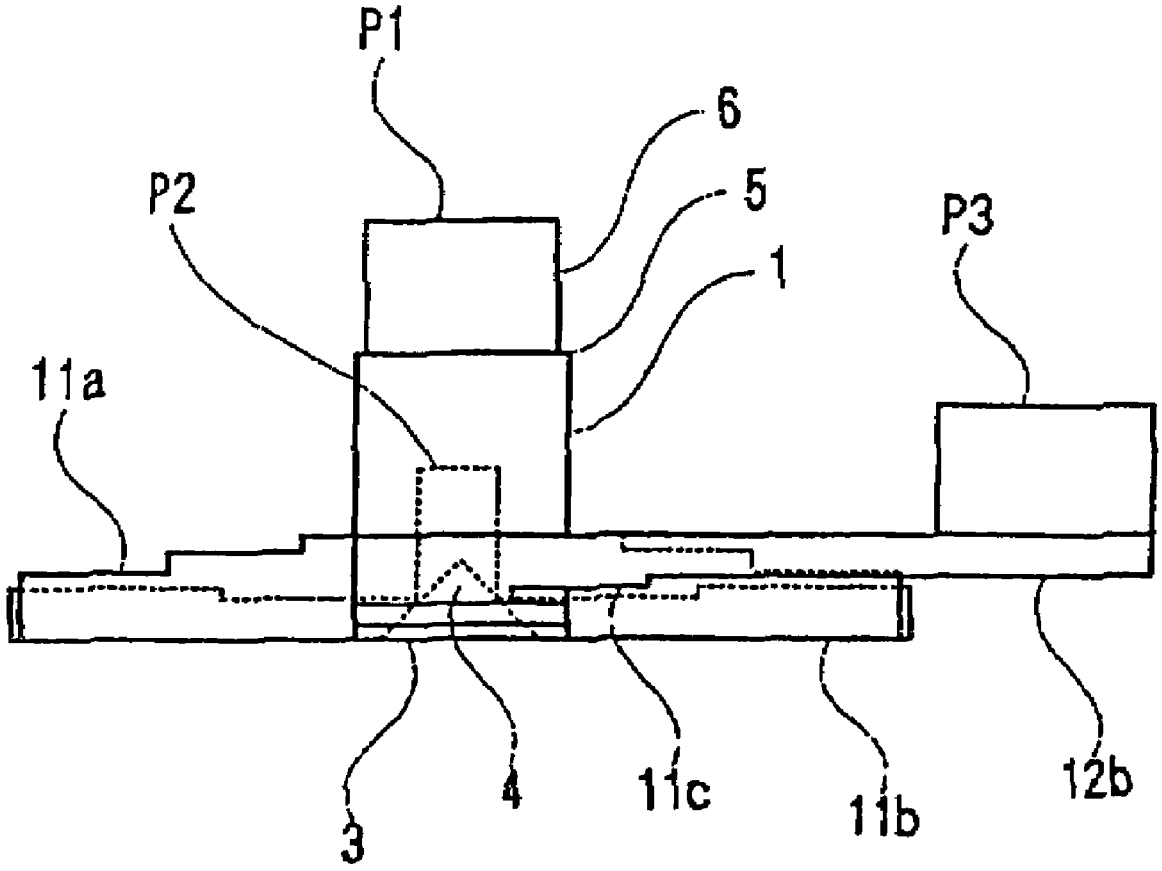
FIG. 6 is a side view of the waveguide type polarizer according to Embodiment Mode 4 of the present invention.

FIG. 5 is a plan view showing a construction of a waveguide type polarizer according to Embodiment Mode 4 of the present invention. In addition, FIG. 6 is a side view showing a construction of the waveguide type polarizer according to Embodiment Mode 4 of the present invention. In FIG. 5 and FIG. 6, reference symbols 11*a* to 11*d* respectively designate first to fourth rectangular waveguide multistage transformers which are respectively connected to first to fourth rectangular branching waveguides 2*a* to 2*d*, each of which has a curved tube axis at an H-plane, and opening diameters of which become smaller as they depart from the rectangular branching waveguides 2*a* to 2*d*; reference symbol 12*a* designates a first rectangular waveguide E-plane T-junction connected to the first rectangular waveguide multistage transformer 11*a* and the second rectangular waveguide multistage transformer 11*b*; reference symbol 12*b* designates a second rectangular waveguide E-plane T-junction connected to the third rectangular waveguide multistage transformer 11*a* and the fourth rectangular waveguide multistage transformer 11*d*; reference symbol P1 designates an input terminal of the second square main waveguide 6; reference symbol P2 designates an output terminal of the rectangular waveguide E-plane T-junction 12*a*; reference symbol P3 designates an output terminal of the rectangular waveguide E-plane T-junction 12*b*; reference symbol H designates a horizontally polarized electric wave; and reference symbol V designates vertically polarized electric wave.

Next, an operation will hereinbelow be described. Now, assuming that the horizontally polarized electric wave H of a basic mode (TE01-mode) is inputted through the terminal P1, this electric wave is propagated through the square waveguide step 5, the square main waveguide 1, the rectangular branching waveguides 2*a* and 2*b*, and the rectangular waveguide multistage transformers 11*a* and 11*b* to compose the separated electric waves again in the rectangular waveguide E-plane T-junction 12*a* to output the composite electric wave in the form of an electric wave of a basic mode (TE10-mode) in each branching waveguide through the terminal P2.

Here, for the electric wave H, each of spaces defined between upper and lower sidewalls of the rectangular branching waveguides 2*c* and 2*d* is designed so as to be equal to or smaller than a half of the free-space wavelength of the frequency band in use. Thus, the electric wave H hardly leaks to the sides of the rectangular waveguides 2*c* and 2*d* due to the cut-off effect of those spaces. In addition, since a direction of an electric field is changed along the metallic block 4 and the short-circuit plate 3 as shown in FIG. 2, the electric field is distributed in a state in which two rectangular waveguide E-plane miter-like bends excellent in reflection characteristics are equivalently and symmetrically placed. For this reason, the electric wave H inputted through the terminal P1 is efficiently outputted to the rectangular waveguides 2*a* and 2*b* while suppressing the reflection to the terminal P1 and the leakage to the rectangular waveguides 2*c* and 2*d*.

Moreover, the square waveguide step 5 is designed such that a stepped portion thereof is much smaller than the free-space wavelength of the frequency band in use. Thus, with respect to the reflection characteristics thereof, a reflection loss is large in a frequency band in the vicinity of the cut-off frequency of the basic mode of the electric wave H, while the reflection loss is very small in a frequency band any frequency of which is higher than the cut-off frequency to some extent. This is similar to the reflection characteristics of the above-mentioned branch portion. Therefore, the square waveguide step 5 is installed in a position where a reflected wave from the branch portion and a reflected wave due to the square waveguide step 5 cancel each other in the vicinity of the cut-off frequency, so that it becomes possible to suppress degradation of the reflection characteristics in a frequency band in the vicinity of the cut-off frequency without impairing the excellent reflection characteristics in the frequency band any frequency of which is higher than the cut-off frequency of the basic mode of the electric wave H to some extent.

Furthermore, each of the rectangular waveguide multistage transformers 11*a* and 11*b* has a curved tube axis, and has a plurality of stepped portions provided on an upper sidewall surface thereof, and also each of intervals of the stepped portions becomes about ¼ of a guide wavelength with respect to a waveguide central line. Thus, finally, electric waves in the rectangular branching waveguides 2*a* and 2*b* which are obtained by separating the electric wave H can be composed in the rectangular waveguide E-plane T-junction 12*a* and the composite electric wave can be efficiently outputted to the terminal P2 without impairing the reflection characteristics.

On the other hand, assuming that the vertically polarized electric wave V of a basic mode (TE10-mode) is inputted through the terminal P1, this electric wave is propagated through the square waveguide step 5, the square main waveguide 1, the rectangular branching waveguides 2*c* and 2*d*, and the rectangular waveguide multistage transformers 11*c* and 11*d* to compose the separated electric waves in the rectangular waveguide E-plane T-junction 12*b* to output the composite wave in the form of an electric wave of a basic mode (TE10-mode) in each branching waveguide through the terminal P3.

Here, for the electric wave V, each of spaces defined between upper and lower sidewalls of the rectangular branching waveguides 2*a* and 2*b* is designed so as to be equal to or smaller than a half of the free-space wavelength of the frequency band in use. Thus, the electric wave V hardly leaks to the sides of the rectangular waveguides 2*a* and 2*b* due to the cut-off effect of those spaces. In addition, since a direction of an electric field is changed along the metallic block 4 and the short-circuit plate 3 as shown in FIG. 2, an electric field is distributed in a state in which two rectangular waveguide E-plane miter-like bends excellent in reflection characteristics are equivalently and symmetrically placed. For this reason, the electric wave V inputted through the terminal P1 is efficiently outputted to the rectangular waveguides 2*c* and 2*d* while suppressing the reflection to the terminal P1 and the leakage to the rectangular waveguides 2*a* and 2*b*.

Moreover, the square waveguide step 5 is designed such that a stepped portion thereof is much smaller than the free-space wavelength of the frequency band in use. Thus, with respect to the reflection characteristics thereof, a reflection loss is large in a frequency band in the vicinity of the cut-off frequency of the basic mode of the electric wave V, while the reflection loss is very small in a frequency band any frequency of which is higher than the cut-off frequency to some extent. This is similar to the reflection characteristics of the above-mentioned branch portion. Therefore, the square waveguide step 5 is installed in a position where a reflected wave from the branch portion and a reflected wave due to the square waveguide step 5 cancel each other in the vicinity of the cut-off frequency, so that it becomes possible to suppress degradation of the reflection characteristics in a frequency band in the vicinity of the cut-off frequency without impairing the excellent reflection characteristics in the frequency band any frequency of which is higher than the cut-off frequency of the basic mode of the electric wave V to some extent.

Furthermore, each of the rectangular waveguide multistage transformers 11*c* and 11*d* has a curved tube axis, and has a plurality of stepped portions provided on a lower sidewall surface thereof, and also each of intervals of the stepped portions becomes about ¼ of a guide wavelength with respect to a waveguide central line. Thus, finally, electric waves in the rectangular branching waveguides 2*c* and 2*d* which are obtained by separating the electric wave V can be composed in the rectangular waveguide E-plane T-junction 12*b* so as to avoid interference with the rectangular waveguide multistage transformers 11*a* and 11*b*, and the rectangular waveguide E-plane T-junction 12*a*, and the composite electric wave can be efficiently outputted to the terminal P3 without impairing the reflection characteristics.

The above-mentioned operation principles have been described with respect to the case where the terminal P1 is determined as an input terminal, and the terminals P2 and P3 are determined as output terminals. However, the above-mentioned operation principles are also applied to a case where the terminals P2 and P3 are determined as input terminals, and the terminal P1 is determined as an output terminal.

As described above, according to Embodiment Mode 4, the polarizer is constituted by: the first and second square main waveguides; the first to fourth rectangular branching waveguides branching perpendicularly and symmetrically with respect to a tube axis of the first square main waveguide; the short-circuit plate for shutting one terminal of the first square main waveguide; the square pyramid-like metallic block provided on the short-circuit plate; the square waveguide step which is sandwiched between the first square main waveguide and the second square main waveguide, and has an opening diameter that is increased toward the branch portion; the first and second rectangular waveguide multistage transformers which are respectively connected to the first and second rectangular branching waveguides, each of which has a curved tube axis, and each of which has a plurality of stepped portions provided on an upper sidewall surface thereof; the third and fourth rectangular waveguide multistage transformers which are respectively connected to the third and fourth rectangular branching waveguides, each of which has a curved tube axis, and each of which has a plurality of stepped portions provided on a lower sidewall surface thereof; and the first and second rectangular waveguide E-plane T-junctions. Thus, an effect is obtained in that the excellent reflection characteristics and isolation characteristics can be realized in a broad frequency band including the vicinity of the cut-off frequency of the basic mode of the square main waveguide.

In addition, an effect is obtained in that with respect to the whole polarizer including a composition circuit portion for composing the horizontally polarized waves H and the vertically polarized electric waves V, respectively, which are separated through the four rectangular branching waveguides, the miniaturization can be promoted for the direction of the tube axis of the square main waveguide.

Moreover, since a construction is adopted in which a metallic thin plate and a metallic post are not used, an effect is obtained in that the level of difficulty in processing can be lowered, with the result that the cost reduction promotion can be realized.

Embodiment Mode 5

Figure 7:
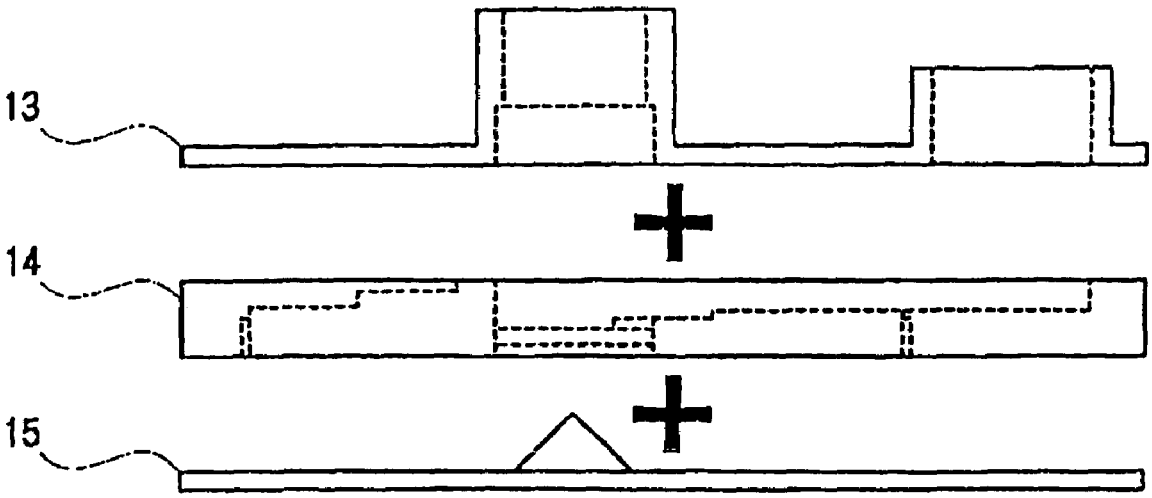
FIG. 7 is a schematic constructional view of a waveguide type polarizer according to Embodiment Mode 5 of the present invention.

In Embodiment Mode 4 above, the description has been made of the waveguide type polarizer provided with: the first square main waveguide 1; the second square main waveguide 6; the first to fourth rectangular branching waveguides 2*a* to 2*d* branching perpendicularly and symmetrically with respect to the tube axis of the square main waveguide 1; the short-circuit plate 3 for shutting one terminal of the square main waveguide 1; the square pyramid-like metallic block 4 provided on the short-circuit plate 3; the square waveguide step 5 which is sandwiched between the square main waveguide 1 and the square main waveguide 6, and has an opening diameter that is increased toward the branch portion; the first rectangular waveguide multistage transformer 11*a* which is connected to the rectangular branching waveguide 2*a*, which has a curved tube axis, and which has a plurality of stepped portions provided on an upper sidewall surface thereof; the second rectangular waveguide multistage transformer 11*b* which is connected to the rectangular branching waveguide 2*b*, each of which has a curved tube axis, and each of which has a plurality of stepped portions provided on an upper sidewall surface thereof; the third rectangular waveguide multistage transformer 11*c* which is connected to the rectangular branching waveguide 2*c*, each of which has a curved tube axis, and each of which has a plurality of stepped portions provided on a lower sidewall surface thereof; the fourth rectangular waveguide multistage transformer 11*d* which is connected to the rectangular branching waveguide 2*d*, each of which has a curved tube axis, and each of which has a plurality of stepped portions provided on a lower sidewall surface thereof; and the first and second rectangular waveguide E-plane T-junctions 12*a* and 12*b*. However, in this Embodiment Mode 5, as shown in FIG. 7, all of those components are constructed by subjecting first to third metallic blocks 13 to 15 to digging-processing and then combining the resultant first to third metallic blocks 13 to 15 with one another. Note that, portions exhibited by broken lines in FIG. 7 correspond to the portions exhibited by solid lines and broken lines in FIG. 6 except the metallic block 4.

Conventionally, when a waveguide circuit is constructed, components need to be connected to one another with flanges. Then, since an occupancy area of the flange portion is much larger than the size of a waveguide, the occupancy area of the flanges is also increased all the more since if the number of components is increased, the number of flanges is also increased in proportion to that number. However, according to this Embodiment Mode 5, since the components obtained through the digging processing have only to be combined with one another, connection supporting mechanisms such as the flanges and the like required for connection among the components are greatly reduced. Hence, an effect is obtained in that the miniaturization can be largely promoted with respect to the direction of the tube axis of the square main waveguide.

Embodiment Mode 6

Figure 8:
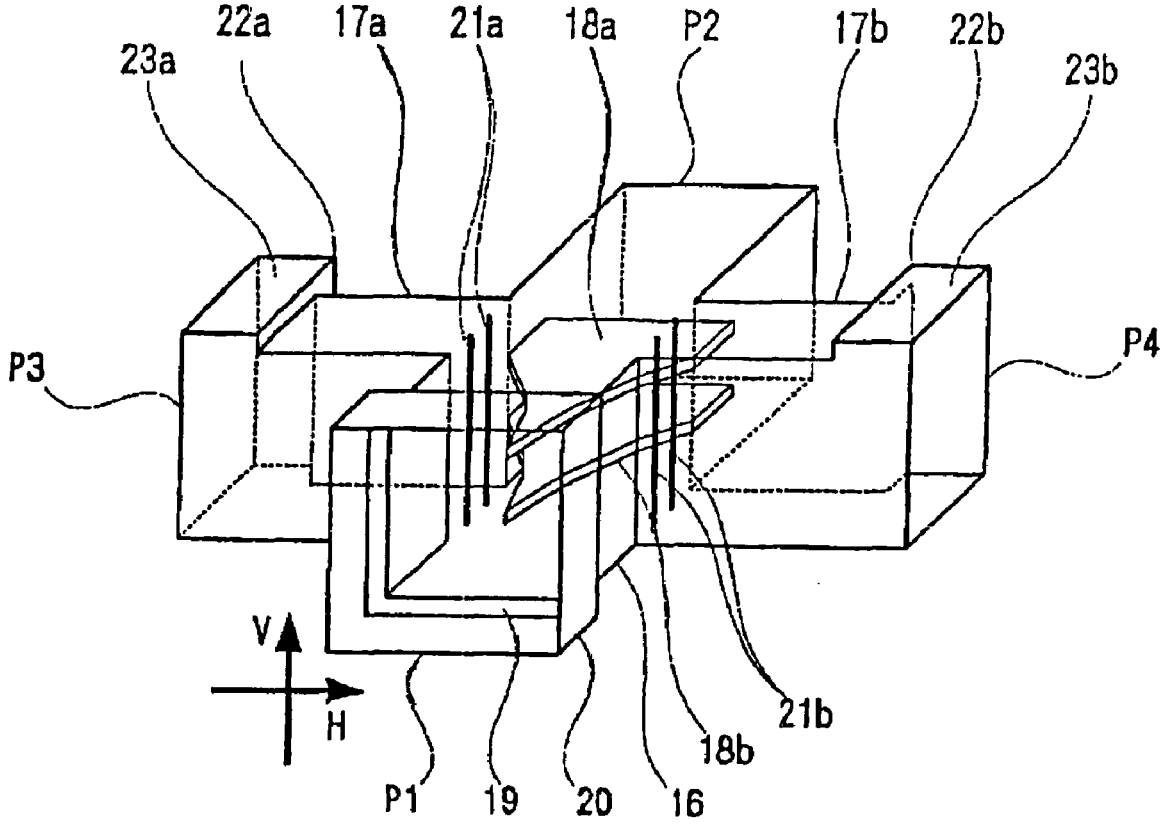
FIG. 8 is a perspective view of a waveguide type polarizer according to Embodiment Mode 6 of the present invention.
Figure 9:
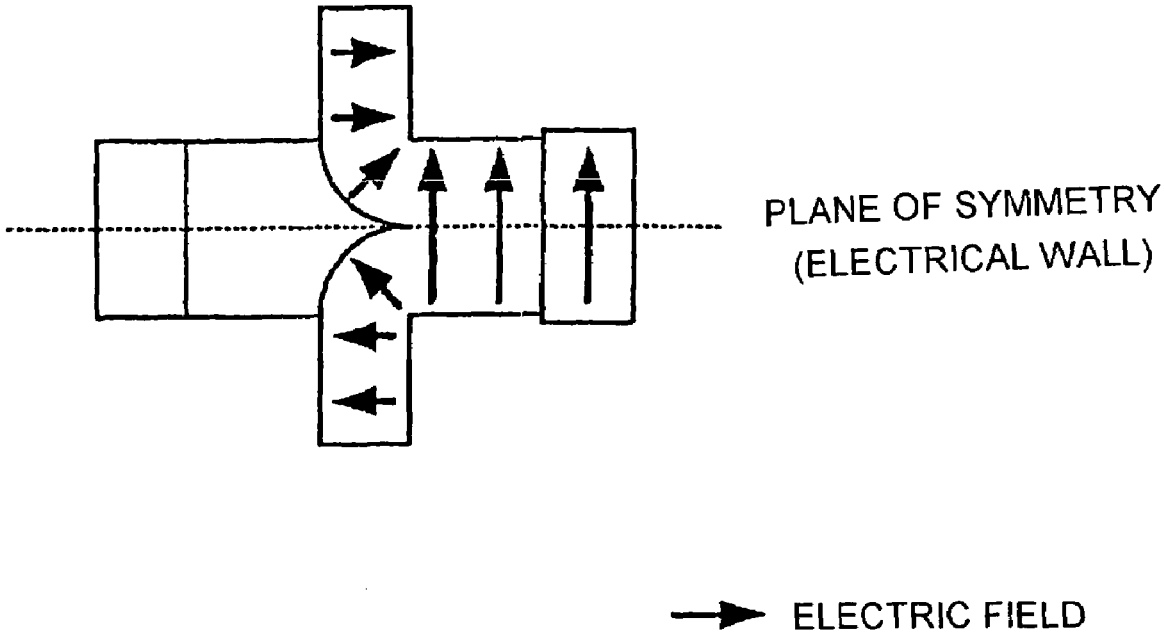
FIG. 9 is an explanatory view showing the operation of wave branching of an electric wave.

FIG. 8 is a perspective view showing a construction of a waveguide type polarizer according to Embodiment Mode 6 of the present invention. In addition, FIG. 9 is a side view of a branch portion useful in explaining distribution of an electric field of a basic mode when inputting a horizontally polarized wave in the waveguide type polarizer shown in FIG. 8. Moreover, FIG. 10 is a cross sectional view of a main waveguide useful in explaining distribution of an electric field of an unnecessary higher mode which is generated when inputting the horizontally polarized wave in the waveguide type polarizer shown in FIG. 8.

Figure 10:
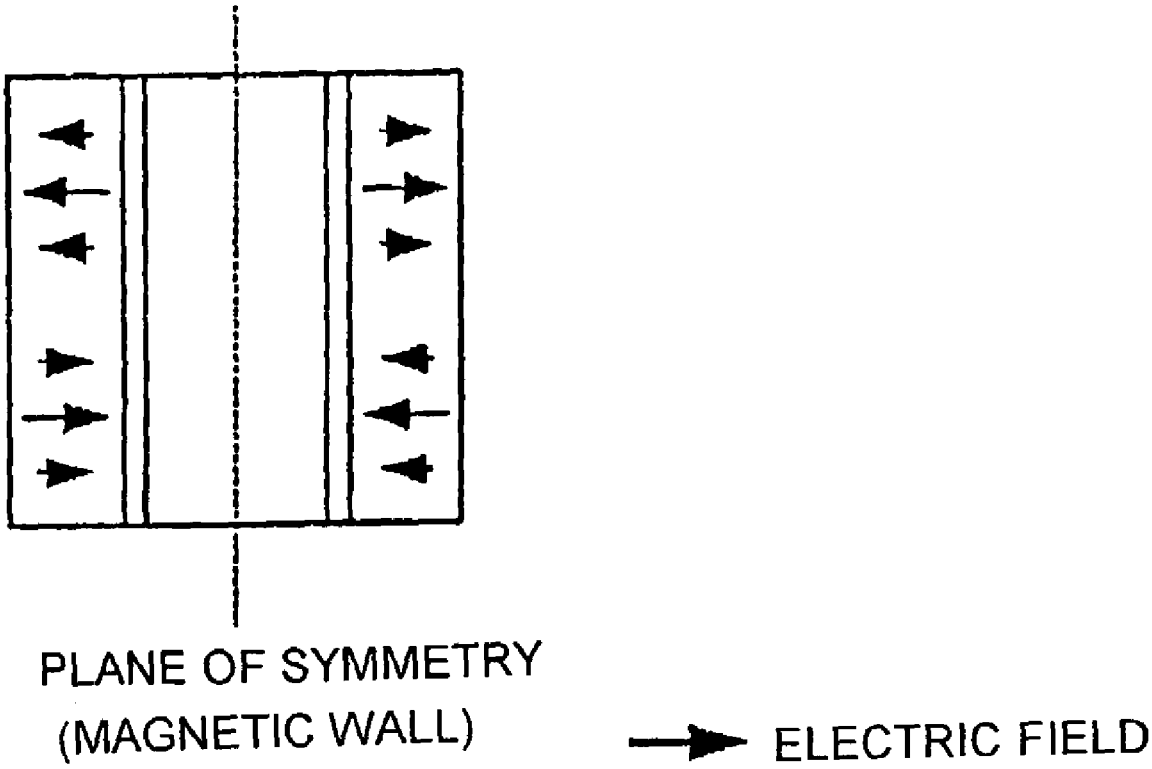
FIG. 10 is an explanatory view showing principles with which an unnecessary higher mode is suppressed.

In FIGS. 8 to 10, reference numeral 16 designates a first square main waveguide through which a vertically polarized wave and a horizontally polarized electric wave are transmitted; reference symbols 17*a* and 17*b* respectively designate two first and second rectangular branching waveguides branching perpendicularly and symmetrically with respect to a tube axis of the square main waveguide 16; reference symbols 18*a* and 18*b* respectively designate metallic thin plates which are inserted into the square main waveguide 26 and which each have arcuate cutouts formed in a symmetrical shape; reference numeral 19 designates a square waveguide step which is connected to one terminal of the square main waveguide 16, an opening diameter of which is decreased toward the branch portion, and a stepped portion of which is much smaller than a free-space wavelength of a frequency band in use; reference numeral 20 designates a second square main waveguide which is connected to the square waveguide step, and through which the vertically polarized wave and the horizontally polarized wave are transmitted; reference symbols 21*a* and 21*b* respectively designate first and second group of metallic posts which are respectively provided within the rectangular branching waveguides 17*a* and 17*b* and in the positions near a connection portion with the square waveguide 16; reference symbols 22*a* and 22*b* respectively designate first and second rectangular waveguide steps which are respectively connected to the rectangular branching waveguides 17*a* and 17*b*, an opening diameter of each of which is decreased toward the branch portion, and a stepped portion of each of which is much smaller than the free-space wavelength of the frequency band in use; reference symbols 23*a* and 23*b* respectively designate third and fourth rectangular branching waveguides which are respectively connected to the rectangular waveguide steps 22*a* and 22*b*; reference symbol P1 designates an input terminal of the square main waveguide 20; reference symbol P2 designates an output terminal of the first square main waveguide 16; reference symbols P3 and P4 respectively designate output terminals of the third and fourth branching waveguides 23*a* and 23*b*; reference symbol V designates a vertically polarized wave; and reference symbol H designates a horizontally polarized wave.

Next, an operation will hereinbelow be described. Now, assuming that the horizontally polarized electric wave H of a basic mode (TE01-mode) is inputted through the terminal P1, this electric wave is propagated through the square waveguide step 19, the square main waveguide 16, the group of metallic posts 21*a* and 21*b*, the rectangular branching waveguides 17*a* and 17*b*, the rectangular waveguide steps 22*a* and 22*b*, and the rectangular branching waveguides 23*a* and 24*b* to be outputted in the form of electric waves of a basic mode (TE10-mode) in each branching waveguide through the terminals P3 and P4, respectively.

Here, for the electric wave H, each of a space defined between an upper sidewall of the square main waveguide 16 and the metallic thin plate 18*a*, a space defined between the metallic thin plates 18*a* and 18*b*, and a space defined between the metallic thin plate 18*b* and a lower sidewall of the main waveguide 16 is designed so as to be equal to or smaller than a half of the free-space wavelength of the frequency band in use. Thus, the electric wave H hardly leaks to the side of the terminal P2 of the square main waveguide 16 due to the cut-off effect of those spaces. In addition, since a direction of the electric field is changed along the metallic thin plates 18*a* and 18*b* as shown in FIG. 9, an electric wave is distributed in a state in which two rectangular waveguide E-plane arcuate bends highly excellent in reflection characteristics are equivalently and symmetrically placed. For this reason, the electric wave H inputted through the terminal P1 is efficiently outputted to the terminals P2 and P3, respectively, while suppressing the reflection to the terminal P1 and the leakage to the terminal P2.

In addition, the metallic thin plates 18*a* and 18*b* have the same shape, and are vertically symmetrical within the square main waveguide 16, and also are mounted in positions apart from the vicinity of the center. For this reason, as shown in FIG. 10, when inputting the horizontally polarized wave, the vertically symmetrical planes become magnetic walls in a region defined between the metallic thin plates 18*a* and 18*b*, and hence in principle, a TE20-mode as a higher mode becoming a cause of degradation of the reflection characteristics is not generated. Therefore, an effect is offered in that the degradation of the reflection characteristics when inputting the horizontally polarized wave can be suppressed to a frequency band in the vicinity of a frequency twice as high as a cut-off frequency of a basic mode (TE01-mode) of the horizontally polarized wave H.

Moreover, the square waveguide step 19 is designed such that a stepped portion thereof is much smaller than the free-space wavelength of the frequency band in use. Thus, with respect to the reflection characteristics thereof, a reflection loss is large in a frequency band in the vicinity of the cut-off frequency of the basic mode of the electric wave H, while the reflection loss is very small in a frequency band any frequency of which is higher than the cut-off frequency to some extent. This is similar to the reflection characteristics of the above-mentioned branch portion. Therefore, the square waveguide step 19 is installed in a position where a reflected wave from the branch portion and a reflected wave due to the square waveguide step 19 cancel each other in the vicinity of the cut-off frequency, so that it becomes possible to improve the reflection characteristics in a frequency band in the vicinity of the cut-off frequency without impairing the excellent reflection characteristics in the frequency band any frequency of which is higher than the cut-off frequency of the basic mode of the electric wave H.

Likewise, each of the rectangular waveguide steps 22*a* and 22 is designed such that a stepped portion thereof is much smaller than the free-space wavelength of the frequency band in use. Thus, with respect to the reflection characteristics thereof, a reflection loss is large in a frequency band in the vicinity of the cut-off frequency of the basic mode of the electric wave H, while the reflection loss is very small in a frequency band any frequency of which is higher than the cut-off frequency to some extent. This is similar to the reflection characteristics of the above-mentioned branch portion. Therefore, the rectangular waveguide steps 22*a* and 22*b* are installed in positions where a reflected wave from the branch portion and reflected waves due to the rectangular waveguide steps 22*a* and 22*b* cancel each other in the vicinity of the cut-off frequency, so that it becomes possible to further improve the reflection characteristics in the frequency band in the vicinity of the cut-off frequency without impairing the excellent reflection characteristics in the frequency band any frequency of which is higher than the cut-off frequency of the basic mode of the electric wave H.

On the other hand, assuming that the vertically polarized electric wave V of a basic mode (TE10-mode) is inputted through the terminal P1, this electric wave is propagated through the square waveguide step 19, and the square main waveguide 16 to be outputted in the form of an electric wave of a basic mode (TE10-mode) in the square waveguide through the terminal P2.

Here, for the electric wave V, each of spaces defined between upper and lower sidewalls of the rectangular branching waveguides 17*a* and 17*b* is designed so as to be equal to or smaller than a half of the free-space wavelength of the frequency band in use. Thus, the electric wave V hardly leaks to the sides of the terminals P3 and P4 due to the cut-off effect of those spaces. In addition, since the surfaces each having a large width of the metallic thin plates 18*a* and 18*b* perpendicularly intersect a direction of the electric field of the basic mode of the electric wave V and a thickness of each metallic thin plate is much smaller than the free-space wavelength, no reflection characteristics of the electric wave V is impaired. Thus, the electric wave V inputted through the terminal P1 is efficiently outputted to the terminal P2 while suppressing the reflection to the terminal P1 and the leakage to the terminals P3 and P4.

In addition, the leakage of the electric wave of an unnecessary higher mode generated in the branch portion when making the vertically polarized electric wave V incident to the sides of the rectangular branching waveguides 17*a* and 17*b* is cut off by the group of metallic posts 21*a* and 21*b*. Hence, the disturbance of the electromagnetic field in the vicinity of the branch portion is suppressed, and finally, the excellent reflection characteristics are obtained over a broad band.

Furthermore, the square waveguide step 19 is designed such that a stepped portion thereof is much smaller than the free-space wavelength of the frequency band in use. Thus, with respect to the reflection characteristics thereof, a reflection loss is large in a frequency band in the vicinity of the cut-off frequency of the basic mode of the electric wave V, while the reflection loss is very small in a frequency band any frequency of which is higher than the cut-off frequency to some extent. This is similar to the reflection characteristics of the above-mentioned branch portion. Therefore, the square waveguide step 19 is installed in a position where a reflected wave from the branch portion and a reflected wave due to the square waveguide step 19 cancel each other in the vicinity of the cut-off frequency, so that it becomes possible to suppress the degradation of the reflection characteristics in the frequency band in the vicinity of the cut-off frequency without impairing the excellent reflection characteristics in the frequency band any frequency of which is higher than the cut-off frequency of the basic mode of the electric wave V.

The above-mentioned operation principles have been described with respect to the case where the terminal P1 is determined as an input terminal, and the terminals P2 to P4 are determined as output terminals. However, the above-mentioned operation principles are also applied to a case where the terminals P2 to P4 are determined as input terminals, the terminal P1 is determined as an output terminal, and the input waves which have been respectively inputted through the terminals P3 and P4 are made 180 degrees out of phase with each other and are made equal in amplitude to each other.

As described above, according to this Embodiment Mode 6, the polarizer is constituted by: the first and second square main waveguides; the first and second rectangular branching waveguides branching perpendicularly and symmetrically with respect to the tube axis of the first square main waveguide; the metallic thin plates which are inserted into the first square main waveguide and which each have the arcuate cutouts symmetrically formed; the square waveguide step which is sandwiched between the first square main waveguide and the second square main waveguide, and the opening diameter of which is decreased toward the branch portion; the first and second group of metallic posts which are respectively mounted within the first and second rectangular branching waveguides; the third and fourth rectangular branching waveguides; and the first and second rectangular waveguide steps which are sandwiched between the first and second rectangular branching waveguides, and the third and fourth rectangular branching waveguides, and the opening diameter of each of which is decreased toward the branch portion. Thus, an effect is obtained in that the excellent reflection characteristics and isolation characteristics can be realized in a very broad frequency band including the vicinity of the cut-off frequency of the basic mode of the square main waveguide, and the vicinity of a frequency which is twice as high as the cut-off frequency.

Embodiment Mode 7

Figure 12:
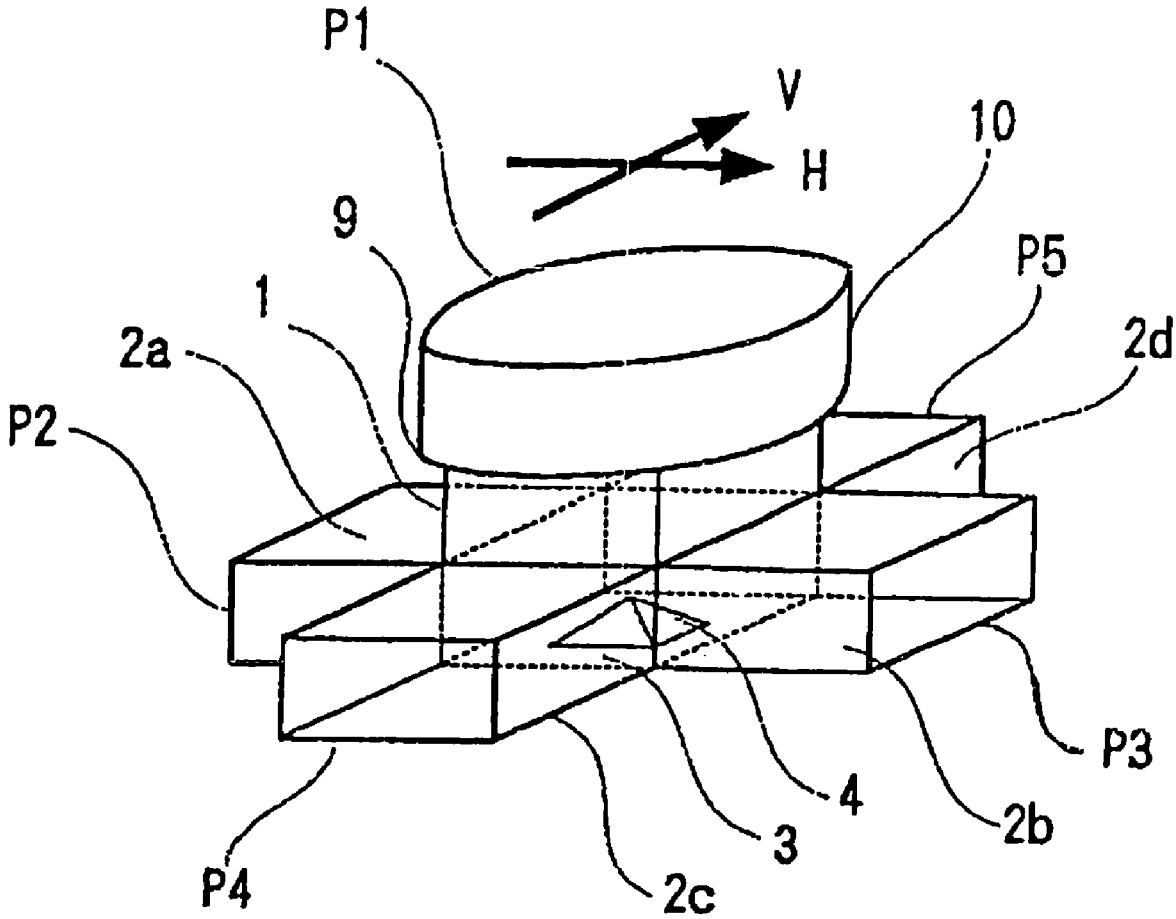
FIG. 12 is a perspective view of a waveguide type polarizer according to Embodiment Mode 8 of the present invention.
Figure 13:
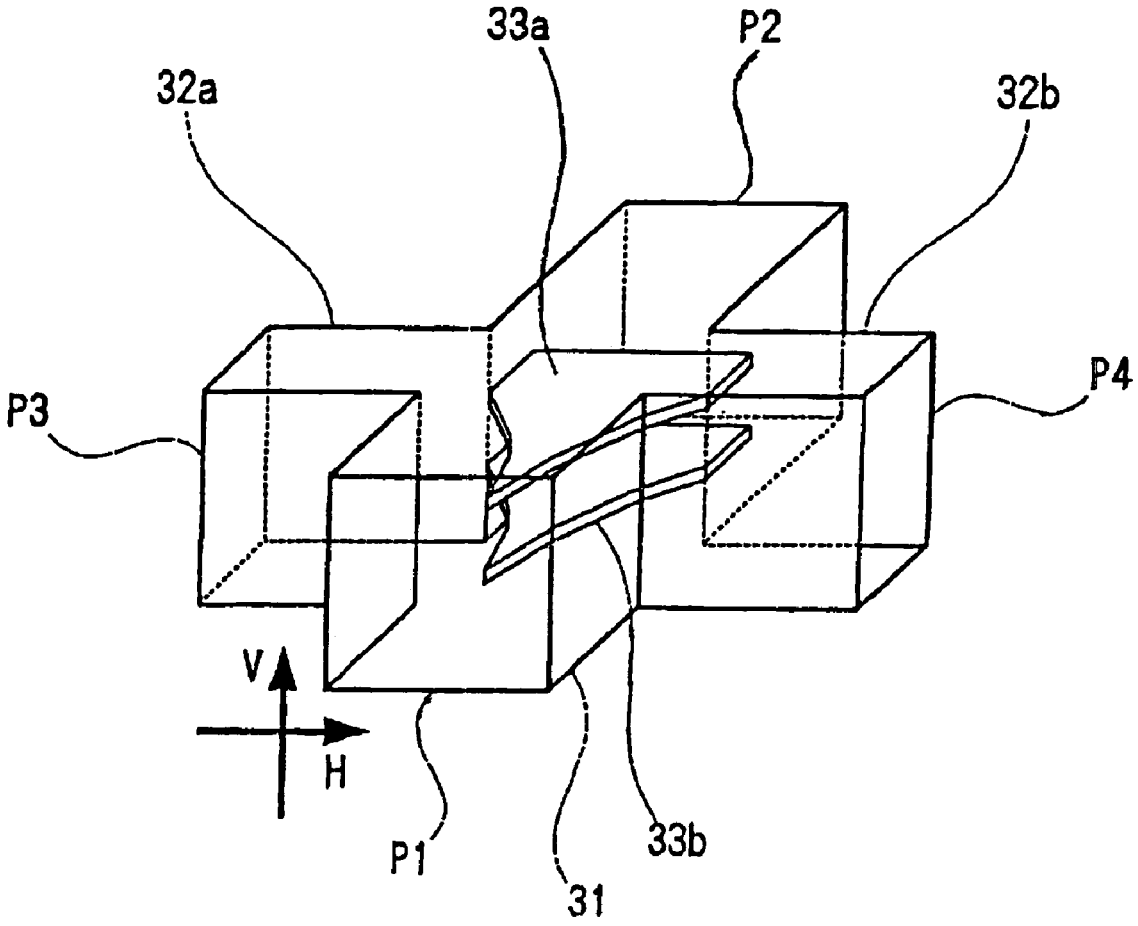
FIG. 13 RELATED ART
FIG. 13 is a perspective view of a conventional waveguide type polarizer.
Figure 14:
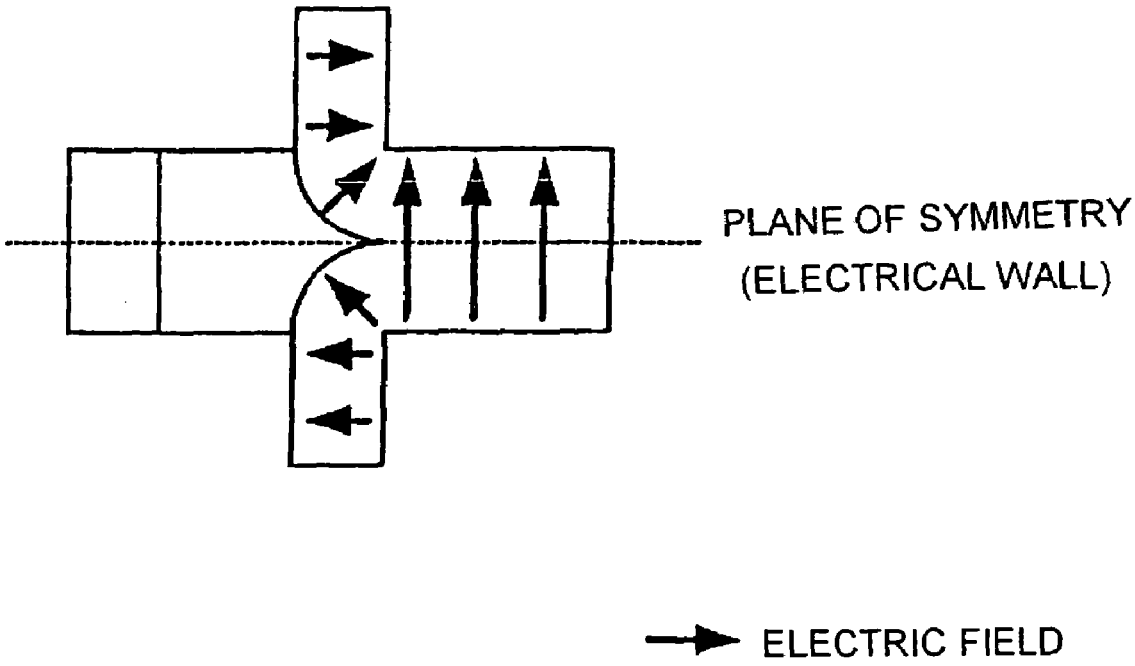
FIG. 14 RELATED ART
FIG. 14 is an explanatory view showing the operation of wave branching of an electric wave.
Figure 15:
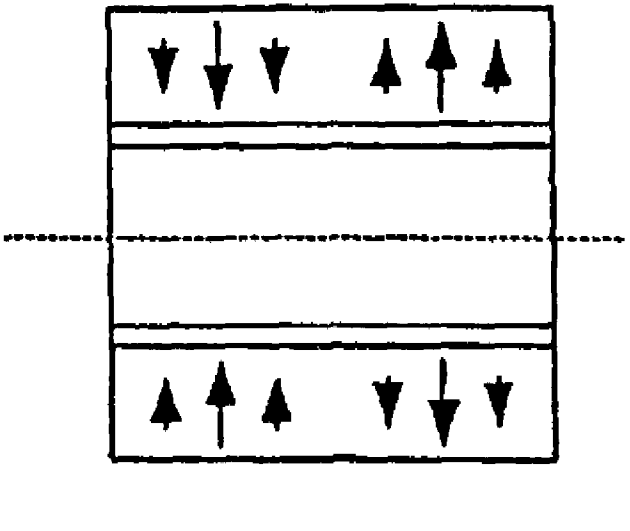
FIG. 15 RELATED ART
FIG. 15 is an explanatory view showing the principles with which the unnecessary higher mode is suppressed.

In Embodiment Mode 1 above, the description has been given of the waveguide type polarizer provided with the square waveguide step 5 which is connected to one terminal of the square main waveguide 1, and the opening diameter of which is increased toward the above-mentioned branch portion, and also the stepped portion of which is much smaller than the free-space wavelength of the frequency band in use. However, if as shown in FIG. 12, a square waveguide step 7 an opening diameter of which is decreased toward the above-mentioned branch portion is provided instead of the square waveguide step 5, then a reflection phase of a reflected wave in the square waveguide step 7 is different from that in the case where the square waveguide step 5 is provided. Hence, a position where a reflected wave from the branch portion and a reflected wave due to the square waveguide step 7 cancel each other in the vicinity of the cut-off frequency may become closer to the branch portion than the canceling position in the case where the square waveguide step 5 is provided. In this case, an effect is obtained in that the polarizer can be further miniaturized.

Embodiment Mode 8

Figure 11:
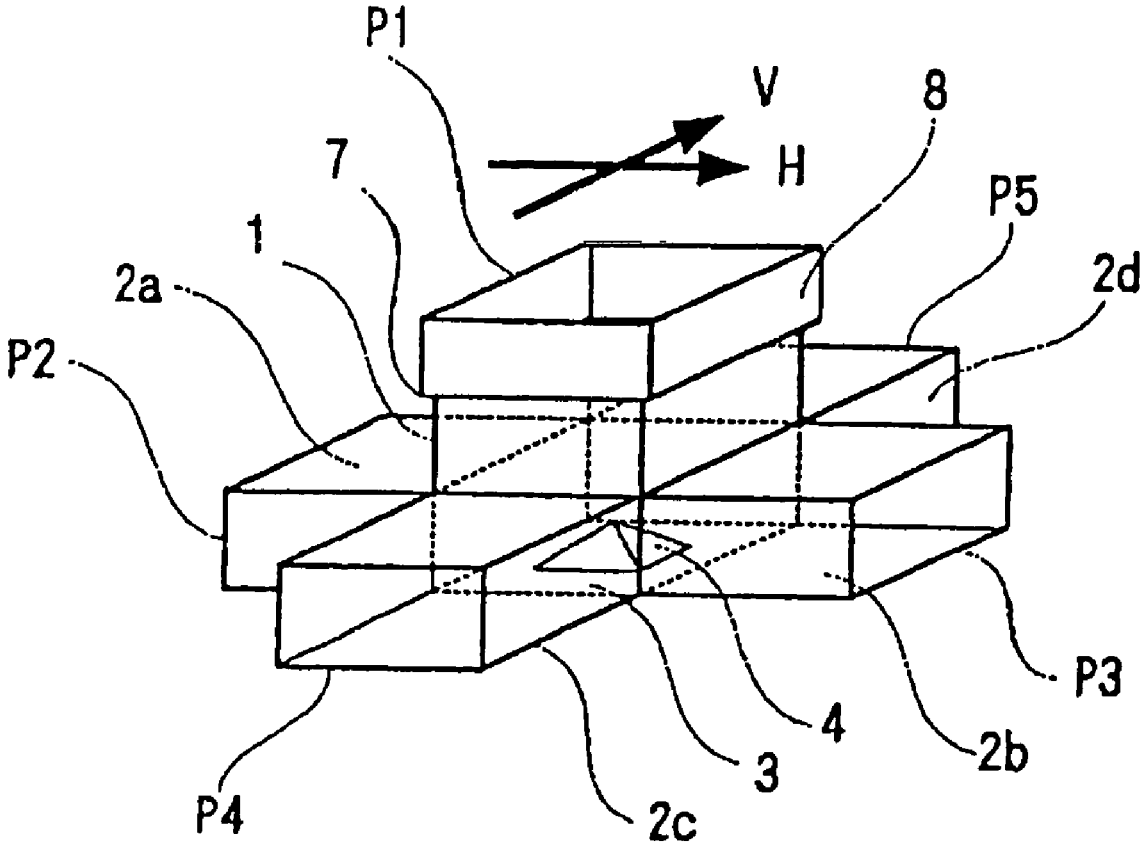
FIG. 11 is a perspective view of a waveguide type polarizer according to Embodiment Mode 7 of the present invention.

In Embodiment Mode 1 above, the description has been given of the waveguide type polarizer provided with the square waveguide step 5 which is connected to one terminal of the square main waveguide 1, and the opening diameter of which is increased toward the above-mentioned branch portion, and also the stepped portion of which is much smaller than the free-space wavelength of the frequency band in use. However, if as shown in FIG. 11, a circular-square waveguide step 9 and a circular main waveguide 10 are provided instead of the square waveguide step 5 and the second square main waveguide 6, then a reflection phase of a reflected wave in the circular-square waveguide step 9 is different from that in a case where the square waveguide step 5 is provided. Hence, a position where a reflected wave from the branch portion and a reflected wave due to the circular-square waveguide step 9 cancel each other in the vicinity of the cut-off frequency may become closer to the branch portion than the canceling position in the case where the square waveguide step 5 is provided. In this case, an effect is obtained in that the polarizer can be further miniaturized.

INDUSTRIAL APPLICABILITY

As set forth, according to the present invention, it is possible to obtain the waveguide type polarizer, which enables miniaturization thereof, shortening of an axis, and broad band promotion, and which has high performance.

What is claimed is:

1. A waveguide type polarizer, comprising:

a first rectangular main waveguide;

first to fourth rectangular branching waveguides branching perpendicularly to the first rectangular main waveguide;

a short-circuit plate connected to one terminal of the first rectangular main waveguide;

a metallic projection provided on the short-circuit plate;

a rectangular waveguide step connected to the other terminal of the first rectangular main waveguide, wherein the rectangular waveguide step is configured to improve reflection characteristics near the cutoff frequency; and a second rectangular main waveguide connected to the rectangular waveguide step.

2. A waveguide type polarizer according to claim 1, wherein:

an opening diameter of the rectangular waveguide step is increased toward a branch portion of the first rectangular main waveguide for the first to fourth rectangular branching waveguides.

3. A waveguide type polarizer according to claim 1, wherein:

an opening diameter of the rectangular waveguide step is decreased toward a branch portion of the first rectangular main waveguide for the first to fourth rectangular branching waveguides.

4. A waveguide type polarizer according to claim 3, further comprising:

a circular-rectangular waveguide step connected to the second rectangular main waveguide; and a circular main waveguide connected to the circular-rectangular waveguide step.

5. A waveguide type polarizer according to claim 1, wherein:

the metallic projection includes a metallic block having a square pyramid-like, step-like, or arcuate cutout.

6. A waveguide type polarizer according to claim 1, wherein:

the metallic projection includes metallic thin plates each having an arcuate, linear, or step-like cutout, which perpendicularly intersect each other.

7. A waveguide type polarizer according to claim 1, further comprising:

a first rectangular waveguide multistage transformer connected to the first rectangular branching waveguide and having a curved tube axis;

a second rectangular waveguide multistage transformer connected to the second rectangular branching waveguide and having a curved tube axis;

a first rectangular waveguide E-plane T-junction connected to the first and second rectangular waveguide multistage transformers;

a third rectangular waveguide multistage transformer connected to the third rectangular branching waveguide and having a curved tube axis;

a fourth rectangular waveguide multistage transformer connected to the fourth rectangular branching waveguide and having a curved tube axis; and a second rectangular waveguide E-plane T-junction connected to the third and fourth rectangular branching waveguides.

8. A waveguide type polarizer according to claim 7, wherein:

the first and second rectangular main waveguides, the first to fourth rectangular branching waveguides, the first to fourth rectangular waveguide multistage transformers, the first and second rectangular waveguide E-plane T-junctions, the short-circuit plate, the metallic projection, and the rectangular waveguide step are constructed by combining a plurality of digging-processed metallic blocks with each other.

9. A waveguide type polarizer, comprising:

a first rectangular main waveguide;

first to fourth rectangular branching waveguides branching perpendicularly to the first rectangular main waveguide;

a short-circuit plate connected to one terminal of the first rectangular main waveguide;

a metallic projection provided on the short-circuit plate;

a circular-rectangular waveguide step connected to the other terminal of the first rectangular main waveguide; and a circular main waveguide connected to the circular-rectangular waveguide step.

10. A waveguide type polarizer according to claim 9, wherein a second rectangular main waveguide connected to the circular-rectangular waveguide step; and a rectangular-waveguide step connected to the second rectangular main waveguide and the first rectangular main waveguide.

11. A waveguide type polarizer, comprising:

a first rectangular main waveguide;

first and second rectangular branching waveguides branching perpendicularly to the first rectangular main waveguide;

first and second conductor thin plates which are mounted in a pair in symmetrical positions within the first rectangular main waveguide;

a rectangular waveguide step which is connected to the other terminal of the first rectangular main waveguide and has an opening diameter that is decreased toward a branch portion of the first rectangular main waveguide for the first and second rectangular branching waveguides; and a second rectangular main waveguide connected to the rectangular waveguide step.

12. A waveguide type polarizer according to claim 11, wherein:

the conductor thin plates are thin plates each having symmetrically arcuate, linear, or step-like cutouts.

13. A waveguide type polarizer according to claim 11, wherein:

for the first and second rectangular branching waveguides, first and second group of metallic posts are provided, respectively.

14. A waveguide type polarizer according to claim 11, wherein:

for the first and second rectangular branching waveguides, first and second rectangular waveguide steps are provided, respectively.

15. A method for processing an electromagnetic wave, comprising:

providing an electromagnetic (EM) wave as input to a waveguide;

propagating the EM wave through a single waveguide step;

splitting the EM wave into components using a metal projection; and receiving the components through a plurality of branching waveguides, wherein some of the branching waveguides only pass an EM wave having a first polarization and the remaining branching waveguides only pass an EM wave having a second polarization.

16. The method according to claim 15, wherein the waveguide is one of a rectangular waveguide and a circular waveguide.

17. The method according to claim 15, wherein the single waveguide step in one of a rectangular waveguide step and a circular-rectangular waveguide step.

18. The method according to claim 15, wherein the metal projection is provided on a short-circuit plate.

19. The method according to claim 15, wherein the metal projection includes one of a metallic block having a square pyramid-like shape and an arcuate cutout shape.

20. The method according to claim 15, wherein the metal projection including a pair of thin conductor plates.

* * * * *